US009760032B1

(12) United States Patent
Sacripante et al.

(10) Patent No.: US 9,760,032 B1
(45) Date of Patent: Sep. 12, 2017

(54) TONER COMPOSITION AND PROCESS

(71) Applicant: Xerox Corporation, Norwalk, CT (US)

(72) Inventors: Guerino G. Sacripante, Oakville (CA); Kimberly D. Nosella, Mississauga (CA); John Lawrence Pawlak, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/053,695

(22) Filed: Feb. 25, 2016

(51) Int. Cl.
*G03G 9/087* (2006.01)
*G03G 9/08* (2006.01)
*G03G 9/093* (2006.01)

(52) U.S. Cl.
CPC ..... *G03G 9/08755* (2013.01); *G03G 9/081* (2013.01); *G03G 9/09371* (2013.01)

(58) Field of Classification Search
CPC ..... G03G 9/08755
See application file for complete search history.

(56) References Cited

U.S. PATENT DOCUMENTS

| | | | | |
|---|---|---|---|---|
| 3,590,000 | A | 6/1971 | Palermiti et al. | |
| 3,655,374 | A | 4/1972 | Palermiti et al. | |
| 3,720,617 | A | 3/1973 | Chatterji et al. | |
| 3,983,045 | A | 9/1976 | Jugle et al. | |
| 4,410,687 | A | 10/1983 | Schimmel et al. | |
| 5,290,654 | A | 3/1994 | Sacripante et al. | |
| 5,308,734 | A | 5/1994 | Sacripante et al. | |
| 5,370,963 | A | 12/1994 | Patel et al. | |
| 5,593,807 | A | 1/1997 | Sacripante et al. | |
| 6,120,967 | A | 9/2000 | Hopper et al. | |
| 6,830,860 | B2 | 12/2004 | Sacripante et al. | |
| 7,029,817 | B2 | 4/2006 | Robinson et al. | |
| 7,736,832 | B2 | 6/2010 | Farrugia et al. | |
| 7,858,285 | B2 | 12/2010 | Sacripante et al. | |
| 8,124,307 | B2 | 2/2012 | Sacripante | |
| 8,466,254 | B2 | 6/2013 | Sacripante | |
| 2011/0053078 | A1* | 3/2011 | Zwartz | G03G 9/0806 430/124.4 |
| 2013/0143153 | A1* | 6/2013 | Murakami | G03G 9/0804 430/108.8 |
| 2013/0244151 | A1 | 9/2013 | Chen et al. | |
| 2015/0153663 | A1 | 6/2015 | Sheik-Qasim et al. | |
| 2015/0168858 | A1 | 6/2015 | Li et al. | |
| 2015/0370187 | A1* | 12/2015 | Takamiya | G03G 9/0827 399/262 |

OTHER PUBLICATIONS

Sacripante et al., Toner Compositions and Processes, U.S. Appl. No. 14/821,624, filed Aug. 7, 2015, not yet published.

* cited by examiner

*Primary Examiner* — Hoa V Le
(74) *Attorney, Agent, or Firm* — Maryluo J. Lavoie, Esq. LLC

(57) ABSTRACT

A toner composition comprising (a) a first lower molecular weight amorphous polyester resin comprising a polyester derived from dodecenyl succinic acid, dodecenyl succinic anhydride, or a combination thereof present in an amount of from about 5 to about 15 weight percent, based on the total weight of the first amorphous polyester; (b) a second higher molecular weight amorphous polyester resin comprising a polyester derived from dodecenyl succinic acid, dodecenyl succinic anhydride, or a combination thereof, and a branching agent derived from a polyacid or polyol component; wherein the dodecenyl succinic acid, dodecenyl succinic anhydride, or combination thereof is present in the second amorphous polyester in an amount of from about 5 to about 15 weight percent, based on the total weight of the second amorphous polyester; (c) a crystalline polyester resin; (d) a wax; and (e) optionally, a colorant.

20 Claims, No Drawings

TONER COMPOSITION AND PROCESS

BACKGROUND

Disclosed herein is a toner and toner process wherein the toner comprises a first lower molecular weight resin and a second higher molecular weight resin, wherein the first resin has a molecular weight that is lower than the molecular weight of the second resin. More specifically, disclosed herein is a lower cost and ecologically friendly toner composition and process comprising (a) a first lower molecular weight unbranched amorphous polyester resin comprising a polyester derived from dodecenyl succinic acid, dodecenyl succinic anhydride, or a combination thereof; wherein the first amorphous polyester is generated by the catalytic polymerization of monomers of an organic diol, an organic diacid, and dodecenyl succinic acid, dodecenyl succinic anhydride, or a combination thereof; wherein the dodecenyl succinic acid, dodecenyl succinic anhydride, or combination thereof, is present in the first amorphous polyester in an amount of from about 5 to about 15 weight percent, based on the total weight of the first amorphous polyester; (b) a second higher molecular weight amorphous polyester resin comprising a polyester derived from dodecenyl succinic acid, dodecenyl succinic anhydride, or a combination thereof, wherein the second higher molecular weight branched amorphous polyester is generated by the catalytic polymerization of monomers of an organic diol, an organic diacid, and dodecenyl succinic acid, dodecenyl succinic anhydride, or a combination thereof, and a branching agent derived from a polyacid or polyol component; wherein the dodecenyl succinic acid, dodecenyl succinic anhydride, or combination thereof is present in the second amorphous polyester in an amount of from about 5 to about 15 weight percent, based on the total weight of the second amorphous polyester; (c) a crystalline polyester resin; (d) a wax; and (e) a colorant.

A number of polyester containing toner compositions are known, including where the polyesters selected are specific amorphous, crystalline or mixtures thereof. Thus, for example, in U.S. Pat. No. 7,858,285, the disclosure of which is totally incorporated herein by reference, there are disclosed emulsion/aggregation toners that include certain crystalline polyesters.

Toner compositions prepared by a number of emulsion/aggregation processes, and which toners may include certain polyesters are known as disclosed in U.S. Pat. Nos. 8,466,254; 7,736,832; 7,029,817; 6,830,860, and 5,593,807, the disclosures of each of these patents being totally incorporated herein by reference.

U.S. patent application Ser. No. 14/821,624, which is hereby incorporated by reference herein in its entirety, describes toner compositions that include a single amorphous polyester resin, a crystalline polyester resin, a colorant and a wax, and where the single amorphous polyester resin contains in excess of zero weight percent of dodecenyl succinic anhydride to less than 16 weight percent of dodecenyl succinic anhydride, or where the single amorphous polyester resin contains in excess of zero weight percent of dodecenyl succinic acid to less than 16 weight percent of dodecenyl succinic acid. While this approach solves certain toner performance issues such as toner blocking, a single resin design does not allow for fine tuning of other properties such as gloss and fusing performance in the final toners.

While currently available toner compositions and toner processes may be suitable for their intended purposes, a need remains for improved toners and toner processes. For example, a need remains for a toner and process that is lower cost and ecologically friendlier than current toners and processes. What is further needed is an improved toner and process providing adequate blocking performance without over plasticization of the amorphous resin. What is further needed is an improved toner and process which allows the crystalline resin to recrystallize from the amorphous resin after the toner is prepared. Thus, a toner composition and process is needed which provides, in combination, reduced cost, ecologically friendly features, good blocking performance, compatibility between the amorphous and crystalline resin without over plasticization of the amorphous resin, and adequate gloss, fusing, and cohesion (blocking) performance.

The appropriate components and process aspects of the each of the foregoing U.S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner composition comprising (a) a first amorphous polyester resin comprising a polyester derived from dodecenyl succinic acid, dodecenyl succinic anhydride, or a combination thereof; wherein the first amorphous polyester is generated by the catalytic polymerization of monomers of an organic diol, an organic diacid, and dodecenyl succinic acid, dodecenyl succinic anhydride, or a combination thereof; wherein the dodecenyl succinic acid, dodecenyl succinic anhydride, or combination thereof, is present in the first amorphous polyester in an amount of from about 5 to about 15 weight percent, based on the total weight of the first amorphous polyester; (b) a second amorphous polyester resin comprising a polyester derived from dodecenyl succinic acid, dodecenyl succinic anhydride, or a combination thereof, and a branching agent derived from a polyacid or polyol component; wherein the second amorphous polyester is generated by the catalytic polymerization of monomers of an organic diol, an organic diacid, dodecenyl succinic acid, dodecenyl succinic anhydride, or combination thereof, and the branching agent; wherein the dodecenyl succinic acid, dodecenyl succinic anhydride, or combination thereof is present in the second amorphous polyester in an amount of from about 5 to about 15 weight percent, based on the total weight of the second amorphous polyester; (c) a crystalline polyester resin; (d) a wax; and (e) a colorant.

Also described is a process comprising mixing (a) a first amorphous polyester resin comprising a polyester derived from dodecenyl succinic acid, dodecenyl succinic anhydride, or a combination thereof; wherein the first amorphous polyester is generated by the catalytic polymerization of monomers of an organic diol, an organic diacid, and dodecenyl succinic acid, dodecenyl succinic anhydride, or a combination thereof; wherein the dodecenyl succinic acid, dodecenyl succinic anhydride, or combination thereof, is present in the first amorphous polyester in an amount of from about 5 to about 15 weight percent, based on the total weight of the first amorphous polyester; (b) a second amorphous polyester resin comprising a polyester derived from dodecenyl succinic acid, dodecenyl succinic anhydride, or a combination thereof, and a branching agent derived from a polyacid or polyol component; wherein the second amorphous polyester is generated by the catalytic polymerization of monomers of an organic diol, an organic diacid, dodecenyl succinic acid, dodecenyl succinic anhydride, or a combination thereof, and the branching agent; wherein the dodecenyl succinic acid, dodecenyl succinic anhydride, or combination thereof is present in the second amorphous polyester in an amount of from about 5 to about 15 weight percent, based on the total weight of the second amorphous polyester; (c) a crystalline polyester resin; (d) a wax; and (e) a colorant; aggregating; and coalescing to form toner particles.

DETAILED DESCRIPTION

Toner compositions herein comprise a combination of lower molecular weight unbranched amorphous polyester, higher molecular weight branched amorphous polyester, crystalline polyester, wax, and, optionally, a colorant. The particular combination of lower molecular weight unbranched amorphous polyester, higher molecular weight branched amorphous polyester, and crystalline polyester enables use of a lower amount of wax over previous toners, while still achieving desired toner characteristics, resulting in reduced overall toner cost. Additionally, the present combination of amorphous and crystalline polyesters enables so-called ultra-low melt (ULM) performance and substantially reduced energy requirements during the fusing operation wherein toner is permanently affixed to the printed substrate. The particular combination of lower molecular weight unbranched amorphous polyester, higher molecular weight branched amorphous polyester, and crystalline polyester also enables use of lower cost crystalline resins, such as poly(1,6-hexylene-1,12-dodecanoate) while still achieving desired toner characteristics including reduced cost, ecologically friendly features, good blocking performance, compatibility between the amorphous and crystalline resin without over plasticization of the amorphous resin, and adequate gloss and fusing performance.

In embodiments, as used herein, the toner comprises a combination of a first resin which is a lower molecular weight unbranched amorphous polyester, and a second resin which is a higher molecular weight branched amorphous polyester, that is, the first resin has a lower molecular weight compared to the second resin, and the second resin has a molecular weight that is higher compared to the first resin. Thus, the first resin is termed a lower molecular weight resin to distinguish it from the second comparatively higher molecular weight resin.

In embodiments, the first resin comprising a lower molecular weight unbranched amorphous polyester is an unbranched resin. However, in embodiments prepared with fumaric acid monomer, the first lower molecular weight unbranched amorphous polyester is cross-linked across the fumaric acid double bond as is evidenced by its molecular weight profile and its rheology. In this embodiment, while there is light cross-linking, the lower molecular weight unbranched amorphous polyester is unbranched in that there is no branching monomer in the formulation.

Generally, a polyester resin may be obtained synthetically, for example, in an esterification reaction involving a reagent comprising polyacid groups and another reagent comprising a polyol.

A polyacid is a monomer for forming a polyester polymer that comprises at least two reactive acidic groups, such as, a carboxylic acid, or at least three acidic groups, or more. Hence, a diacid, a triacid, and so on are encompassed by the term polyacid.

A polyol is a monomer for forming a polyester polymer that comprises at least two reactive hydroxyl groups, such as, an alcohol, or at least three hydroxyl groups, or more. Hence, a dialcohol or diol, a trialcohol or triol, and so on, are encompassed by the term polyol.

While unreacted monomer per se is not present in a polymer, for the purposes herein, a polymer is defined by the component monomers used to make that polymer. Hence, for a polyester made from a polyol and a polyacid, which during the condensation reaction loses a water molecule for each ester bond that is formed, the polymer is said to comprise said polyol and said polyacid. Thus, for example, if 1,2-propanediol and trimellitic acid are reacted to form a polyester, even though technically 1,2-propanediol and trimellitic acid no longer are present in the polyester polymer, herein, the polymer is said to comprise 1,2-propanediol and trimellitic acid.

In embodiments, the amount of DDSA (dodecenyl succinic acid, dodecenyl succinic anhydride, or mixtures thereof) in the final polyester is calculated on a weight basis of monomer(s) utilized.

In certain embodiments, in the current specification, the final composition of the polymer is defined according to the relative amount of each of the constituent monomers that were used to make the polymer on a relative weight basis. For example, if the polyester is described as containing 10 weight percent of a particular monomer, this implies that on a weight basis 10 percent of the reaction mixture, excluding optional catalysts, was this particular monomer.

For the purposes of this disclosure, for monomers that can exist in either diacid or anhydride form (for example dodecenyl succinic acid or dodecenyl succinic anhydride), the diacid form is always used to calculate the relative weight percentages in the final polyester.

The disclosed amorphous polyester resins can generally be prepared by a polycondensation process which involves reacting suitable organic diols and suitable organic diacids in the presence of polycondensation catalysts and dodecenyl succinic acid, dodecenyl succinic anhydride (DDSA), or mixtures thereof, and wherein when embodiments herein refer to dodecenyl succinic acid this also includes dodecenyl succinic anhydride (DDSA).

Toner compositions herein comprise a combination of unbranched low molecular weight amorphous polyester and branched high molecular weight amorphous polyester resin.

In embodiments, a toner composition herein comprises (a) a first lower molecular weight amorphous polyester resin comprising a polyester derived from dodecenyl succinic acid, dodecenyl succinic anhydride, or a combination thereof; wherein the first amorphous polyester is generated by the catalytic polymerization of monomers of an organic diol, an organic diacid, and dodecenyl succinic acid, dodecenyl succinic anhydride, or a combination thereof; wherein the dodecenyl succinic acid, dodecenyl succinic anhydride, or combination thereof, is present in the first amorphous polyester in an amount of from about 5 to about 15 weight percent, based on the total weight of the first amorphous polyester; (b) a second higher molecular weight amorphous polyester resin comprising a polyester derived from dodecenyl succinic acid, dodecenyl succinic anhydride, or a combination thereof, and a branching agent; wherein the second amorphous polyester is generated by the catalytic polymerization of monomers of an organic diol, an organic diacid, dodecenyl succinic acid, dodecenyl succinic anhydride, or combination thereof, and the branching agent; wherein the dodecenyl succinic acid, dodecenyl succinic anhydride, or combination thereof is present in the second amorphous polyester in an amount of from about 5 to about 15 weight percent, based on the total weight of the second amorphous polyester; (c) a crystalline polyester resin; (d) a wax; and (e) optionally, a colorant.

Lower Molecular Weight Unbranched Polyester

As used herein, a lower molecular weight polyester resin has a weight average molecular weight (Mw) of from about 3,000 to about 50,000, or from about 5,000 to about 30,000, or from about 15,000 to about 25,000 grams per mole, as measured by gel permeation chromatography (GPC) relative to polystyrene standards. In embodiments, the first lower molecular weight amorphous polyester resin herein comprises an amorphous polyester resin derived from dodecenyl succinic acid, dodecenyl succinic anhydride, or a combination thereof, wherein the polyester is a lower molecular weight polyester having a weight average molecular weight (Mw) of from about 3,000 to about 50,000, or from about 5,000 to about 30,000, or from about 15,000 to about 25,000 grams per mole. In a specific embodiment, the lower molecular weight amorphous polyester has a weight average molecular weight (Mw) of from about 15,000 to about 25,000 grams per mole.

The first, lower molecular weight polyester resin is unbranched, that is, the polymer formulation does not contain a polyacid or polyol branching agent.

As used herein, branched means the polymer is formulated with a polyacid or polyol branching agent.

As used herein, unbranched means the polymer does not contain, or is not formulated with, a polyacid or polyol branching agent.

In embodiments, the lower molecular weight amorphous polyester is prepared with dodecenyl succinic acid, dodecenyl succinic anhydride, or a combination thereof, wherein the dodecenyl succinic acid, dodecenyl succinic anhydride, or a combination thereof, is present in the first lower molecular weight amorphous polyester in an amount of from about 5 to about 15, or from about 8 to about 14, or from about 9 to about 13, percent by weight, based on the total weight of the low molecular weight amorphous polyester. That is, the combined total amount of dodecenyl succinic acid, dodecenyl succinic anhydride, or a combination thereof. In embodiments, the dodecenyl succinic acid, dodecenyl succinic anhydride, or a combination thereof, wherein the dodecenyl succinic acid, dodecenyl succinic anhydride, or a combination thereof, is present in the first lower molecular weight amorphous polyester in an amount of from about 9 to about 13 percent by weight, based on the total weight of the low molecular weight amorphous polyester.

Polyacid monomers suitable for preparing the lower molecular weight unbranched polyester can be selected from the group consisting of dodecenyl succinic acid, dodecenyl succinic anhydride, terephthalic acid, isophthalic acid, fumaric acid, maleic acid, oxalic acid, succinic acid, glutaric acid, adipic acid, suberic acid, azelaic acid, sebacic acid, decanoic acid, 1,2-dodecanoic acid, phthalic acid, isophthalic acid, terephthalic acid, naphthalene-2,6-dicarboxylic acid, naphthalene-2,7-dicarboxylic acid, cyclohexane dicarboxylic acid, malonic acid mesaconic acid, and diesters or anhydrides thereof.

In certain embodiments, the lower molecular weight polyester is prepared using fumaric acid. In spite of the fact that there is no branching agent in this polyester, rheology shows that the polyester is lightly cross-linked across the double bonds of fumaric acid. As used herein, it is understood that there is light cross-linking, however; this embodiment is termed unbranched as there is no branching agent.

The polyacid can be selected in any suitable or desired amount, in embodiments, in an amount of, for example, from about 48 to about 52 mole percent, or from about 1 to about 10 mole percent of the amorphous polyester resin.

In embodiments, polyol monomers suitable for preparing the lower molecular weight unbranched polyester can be selected from the group consisting of 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, propylene glycol, alkoxylated bisphenol A derivatives such as propoxylated bisphenol A, ethoxylated bisphenol A, and mixtures thereof. In embodiments, the lower molecular weight unbranched polyester is selected from the group consisting of dodecenyl succinic acid, terephthalic acid, fumaric acid, propoxylated bisphenol A, ethoxylated bisphenol A, and mixtures thereof. In certain embodiments, polyol monomers suitable for preparing the lower molecular weight unbranched polyester can be selected from the group consisting of propoxylated bisphenol A and ethoxylated bisphenol A.

The polyol can be selected in any suitable or desired amount, in embodiments, in an amount of, for example, from about 48 to about 52 mole percent of the amorphous polyester resin.

In embodiments, the first amorphous polyester resin is selected from the group consisting of fumaric acid, terephthalic acid, dodecenyl succinic acid, dodecenyl succinic anhydride, trimellitic acid, propoxylated bisphenol A and ethoxylated bisphenol A. In embodiments, the low molecular weight unbranched polyester is selected from the group consisting of dodecenyl succinic acid, terephthalic acid, fumaric acid, propoxylated bisphenol A and ethoxylated bisphenol A.

In certain embodiments, the first amorphous polyester resin is selected from the group consisting of fumaric acid, terephthalic acid, dodecenyl succinic acid, dodecenyl succinic anhydride, propoxylated bisphenol A and ethoxylated bisphenol A.

In embodiments, the first lower molecular weight amorphous polyester has a glass transition temperature of from about 50 to about 70° C., or from about 52 to about 65° C., or from about 58 to about 63° C. In a specific embodiment, the first low molecular weight amorphous polyester has a glass transition temperature of from about 55 to about 65° C.

Higher Molecular Weight Branched Polyester

As used herein, a higher molecular weight polyester resin has a weight average molecular weight (Mw) of from about 20,000 to about 250,000, or from about 40,000 to about 150,000, or from about 50,000 to about 100,000, grams per mole, as measured by gel permeation chromatography (GPC) relative to polystyrene standards. In embodiments, a second amorphous polyester resin herein comprises a polyester derived from dodecenyl succinic acid, dodecenyl succinic anhydride, or a combination thereof, and a branching agent derived from a polyacid or polyol component, wherein the second amorphous polyester is a higher molecular weight branched polyester having a weight average molecular weight of from about 20,000 to about 250,000, or from about 40,000 to about 150,000, or from about 50,000 to about 100,000 grams per mole. In a specific embodiment, the higher molecular weight amorphous polyester has a weight average molecular weight (Mw) of from about 50,000 to about 150,000 grams per mole.

In embodiments, the second amorphous polyester resin comprises dodecenyl succinic acid, dodecenyl succinic anhydride, or combination thereof, in an amount of from about 5 to about 15 weight percent, or from about 8 to about 14 weight percent, or from about 9 to about 13 weight percent, based on the total weight of the second amorphous polyester. In a specific embodiment, the second amorphous polyester resin comprises dodecenyl succinic acid, dodecenyl succinic anhydride, or combination thereof, in an amount of from about 9 to about 13 weight percent based on the total weight of the second amorphous polyester.

The second, higher molecular weight amorphous polyester is a branched polyester. In embodiments, the second, high molecular weight branched amorphous polyester has a degree of branching from about 2 to about 5 percent.

Polyacid monomers suitable for preparing the higher molecular weight branched polyester can be selected from the group consisting of terephthalic acid, dodecenyl succinic acid, dodecenyl succinic anhydride, and trimellitic acid.

The polyacid can be selected in any suitable or desired amount, in embodiments, in an amount of, for example, from about 48 to about 52 mole percent, or from about 1 to about 10 mole percent of the amorphous polyester resin.

Polyol monomers suitable for preparing the higher molecular weight branched polyester can be selected from the group consisting of alkoxylated bisphenol A derivatives such as propoxylated bisphenol A and ethoxylated bisphenol A.

The polyol can be selected in any suitable or desired amount, in embodiments, in an amount of, for example, from about 48 to about 52 mole percent of the amorphous polyester resin.

In embodiments, the higher molecular weight branched amorphous polyester is selected from the group consisting of terephthalic acid, dodecenyl succinic acid, dodecenyl succinic anhydride, trimellitic acid, propoxylated bisphenol A and ethoxylated bisphenol A.

The second, higher molecular weight amorphous polyester can be branched using any suitable or desired branching agent. In embodiments, the second amorphous high molecular weight polyester is generated with a branching agent derived from a polyacid selected from the group consisting of trimellitic acid and timellitic anhydride or a polyol such as glycerol, trimethylolethane, trimethylolpropane. In embodiments, the second amorphous higher molecular weight polyester is generated with a branching agent derived from a polyacid selected from the group consisting of trimellitic acid and trimellitic anhydride or a polyol selected from the group consisting of glycerol, trimethylolethane and trimethylolpropane. In embodiments, the second amorphous polyester resin is generated with a branching agent selected from the group consisting of trimellitic acid, trimellitic anhydride and glycerol. In embodiments, the branching agent is trimellitic acid. In embodiments, the branching agent is trimellitic anhydride. In other embodiments, the polyol branching agent is glycerol.

Any suitable or desired branching agent can be selected to prepare the branched higher molecular weight branched polyester. In embodiments, the polyacid branching agent is a multivalent polyacid selected from the group consisting of trimellitic anhydride, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and so on. In embodiments, the polyacid branching agent is trimellitic anhydride. Alternatively, a polyol branching agent is a multivalent polyol selected from the group consisting of sorbitol, 1,2,3,6-hexanetetrol, 1,4-sorbitane, erythritol, isoerythritol, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. In embodiments, the polyol branching agent is glycerol.

The branching agent may be used in any suitable or desired amount. In embodiments, the branching agent is used in an amount of from about 0.01 to about 10 mole % of the resin, from about 0.05 to about 8 mole % of the resin, or from about 0.1 to about 5 mole % of the resin.

In embodiments, the second higher molecular weight branched amorphous polyester has a glass transition temperature of from about 50 to about 65° C., or from about 52 to about 62° C., or from about 54 to about 57° C. In embodiments, the second high molecular weight branched amorphous polyester has a glass transition temperature of from about 52 to about 62° C. In a specific embodiment, the second high molecular weight branched amorphous polyester has a glass transition temperature of from about 54 to about 57° C.

In embodiments, the second amorphous polyester resin is selected from the group consisting of terephthalic acid, dodecenyl succinic acid, dodecenyl succinic anhydride, trimellitic acid, propoxylated bisphenol A and ethoxylated bisphenol A.

Crystalline Polyester.

Any suitable or desired crystalline polyester can be selected for embodiments herein. A number of crystalline polyesters can be selected for the disclosed toner compositions inclusive of suitable known crystalline polyesters. Specific examples of crystalline polyesters that may be selected for the disclosed toners are poly(1,2-propylene-diethylene-terephthalate), poly(ethylene-terephthalate), poly (propylene-terephthalate), poly(butylene-terephthalate), poly(pentylene-terephthalate), poly(hexylene-terephthalate), poly(heptylene-terephthalate), poly(octylene-terephthalate), poly(ethylene-sebacate) (10:2), poly(propylene-sebacate) (10:3), poly(butylene-sebacate) (10:4), poly (hexylene-sebacate) (10:6), poly(nonylene-sebacate) (10:9), poly(decylene-sebacate) (10:10), poly(dodecylene-sebacate) (10:12), poly(ethylene-adipate) (6:2), poly(propylene-adipate) (6:3), poly(butylene-adipate) (6:4), poly(pentylene-adipate) (6:4), poly(hexylene-adipate) (6:6), poly (heptylene-adipate) (6:7), poly(octylene-adipate) (6:8), poly (ethylene-glutarate) (5:2), poly(propylene-glutarate) (5:3), poly(butylene-glutarate) (5:4), poly(pentylene-glutarate) (5:5), poly(hexylene-glutarate) (5:6), poly(heptylene-glutarate) (5:7), poly(octylene-glutarate) 5:8), poly(ethylene-pimelate) (7:2), poly(propylene-pimelate) (7:3), poly(butylene-pimelate) (7:4), poly(pentylene-pimelate) (7:5), poly (hexylene-pimelate) (7:6), poly(heptylene-pimelate) (7:7), poly(1,2-propylene itaconate), poly(ethylene-succinate) (4:2), poly(propylene-succinate) (4:3), poly(butylene-succinate) (4:4), poly(pentylene-succinate) (4:5), poly(hexylene-succinate) (4:6), poly(octylene-succinate) (4:8), poly(ethylene-dodecanoate) (12:2), poly(propylene-dodecanoate) (12:3), poly(butylene-dodecanoate) (12:4), poly(pentylene-dodecanoate) (12:5), poly(hexylene-dodecanoate) (12:6), poly(nonylene-dodecanoate) (12:9), poly(decylene-dodecanoate) (12:10), poly(dodecylene-dodecanoate) (12:12), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and mixtures thereof, and the like. A specific crystalline polyester selected for the disclosed toners is CPE 12:6, poly(1,6-hexylene-1,12-dodecanoate), which is generated by the reaction of 1,12-dodecanedioc acid and 1,6-hexanediol, and more specifically, wherein the crystalline polyester is poly(1,6-hexylene-1,12-dodecanoate) of the following repeating formulas/structures

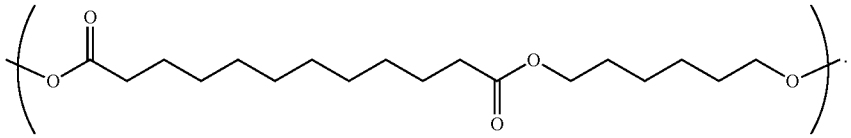

The crystalline resins can possess a number average molecular weight (Mn), as measured by gel permeation chromatography (GPC), of, for example, from about 1,000 to about 50,000, or from about 2,000 to about 25,000. The weight average molecular weight (Mw) of the crystalline polyester resins can be, for example, from about 2,000 to about 100,000, or from about 3,000 to about 80,000, as determined by GPC using polystyrene standards. The molecular weight distribution (Mw/Mn) of the crystalline polyester resin is, for example, from about 2 to about 6, and more specifically, from about 2 to about 4.

The disclosed crystalline polyester resins can be prepared by a polycondensation process by reacting suitable organic diols and suitable organic diacids in the presence of polycondensation catalysts. Generally, a stoichiometric equimolar ratio of organic diol and organic diacid is utilized, however, in some instances, wherein the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized varies, and can be selected in amounts, such as for example, from about 0.01 to about 1, or from about 0.1 to about 0.75 mole percent of the crystalline polyester resin.

Examples of organic diacids or diesters selected for the preparation of the crystalline polyester resins are as illustrated herein, and include fumaric, maleic, oxalic acid, succinic acid, glutaric acid, adipic acid, suberic acid, azelaic acid, sebacic acid, decanoic acid, 1,2-dodecanoic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid is selected in an amount of, for example, from about 48 to about 52 mole percent, of the crystalline polyester resin.

Examples of organic diols which include aliphatic diols selected in an amount of, for example, from about 1 to about 10, or from 3 to about 7 mole percent of the crystalline polyester resin that may be included in the reaction mixture or added thereto, and with from about 2 to about 36 carbon atoms, are 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, alkylene glycols like ethylene glycol or propylene glycol, and the like. The organic diols can be selected in various effective amounts, such as for example, from about 48 to about 52 mole percent of the crystalline polyester resin.

Catalyst.

Examples of suitable polycondensation catalysts utilized for the preparation of the amorphous polyesters and crystalline polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, zinc acetate, titanium isopropoxide, butylstannoic acid available as FASCAT® 4100, or mixtures thereof; and which catalysts are selected in amounts of, for example, from about 0.01 mole percent to about 5 mole percent, from about 0.1 to about 0.8 mole percent, from about 0.2 to about 0.6 mole percent, or more specifically, about 0.2 mole percent, based, for example, on the starting diacid or diester used to generate the polyester resins.

Amounts of First and Second Polyester Present in Toner Composition.

In embodiments, the first lower molecular weight unbranched amorphous polyester resin is present in the toner composition in an amount of from about 30 to about 50, or from about 35 to about 45, or from about 38 to about 42 percent, by weight, based on the total weight of the toner composition.

In embodiments, the second higher molecular weight branched amorphous polyester resin is present in the toner composition in an amount of from about 30 to about 50, or from about 35 to about 45, or from about 38 to about 42 percent, by weight, based on the total weight of the toner composition.

In embodiments, the crystalline polyester resin is present in the toner composition in an amount of from about 2 to about 15, or from about 4 to about 10, or from about 5 to about 8 percent, by weight, based on the total weight of the toner composition.

In a specific embodiment, the first lower molecular weight unbranched amorphous polyester resin is present in the toner composition in an amount of from about 38 to about 42 percent, the second higher molecular weight branched amorphous polyester resin is present in the toner composition in an amount of from about 38 to about 42 percent, and the crystalline polyester resin is present in the toner composition in an amount of from about 5 to about 7.5 percent, wherein percent is by weight, based on the total weight of the toner composition.

In embodiments, the toner composition herein comprises a combination of a lower molecular weight resin and a higher molecular weight resin, both of which contain dodecenyl succinic acid or dodecenyl succinic anhydride. In embodiments, dodecenyl succinic acid or dodecenyl succinic anhydride is selected in an amount such that toner blocking performance with lower molecular weight crystalline polyester is optimized. In embodiments, the crystalline polyester oligomer unit has from about 12 to about 28, or from about 14 to about 24, or from about 16 to about 22 carbon atoms. In a certain embodiment, the crystalline polyester monomer selected has from about 16 to about 22 carbon atoms.

In embodiments, a crystalline polyester is selected wherein the crystalline polyester has an oligomer unit with a carbon to oxygen ratio from about 3 to about 7, or from about 3.5 to about 6, or from about 4 to about 5.5. In a certain embodiment, a crystalline polyester is selected wherein the crystalline polyester has an oligomer unit with a carbon to oxygen ratio from about 4 to about 5.5. Carbon to oxygen ratio can be calculated by counting the total number of carbons and dividing by the total number of oxygens in the oligomer unit, which is simply the dimeric condensation product of one diacid and one diol monomer unit.

In certain embodiments, a toner composition herein comprises wherein the first amorphous polyester resin comprises dodecenyl succinic acid, dodecenyl succinic anhydride, or combination thereof, in an amount of from about 9 to about 13 weight percent, based on the total weight of the first amorphous polyester; the second amorphous polyester resin comprises dodecenyl succinic acid, dodecenyl succinic anhydride, or combination thereof, in an amount of from about 9 to about 13 weight percent, based on the total weight of the second amorphous polyester; and wherein the crystalline polyester has an oligomer unit with a carbon to oxygen ratio of from about 3 to about 7.

Wax.

Numerous suitable waxes may be selected for the toners illustrated herein, and which waxes can be included in the polyester resin containing mixture of the amorphous polyester and the crystalline polyester, in at least one shell, and in both the mixture and the at least one shell.

Examples of optional waxes included in the toner or on the toner surface include polyolefins, such as polypropylenes, polyethylenes, and the like, such as those commercially available from Allied Chemical and Baker Petrolite Corporation; wax emulsions available from Michaelman Inc. and the Daniels Products Company; EPOLENE N-15™ commercially available from Eastman Chemical Products, Inc.; VISCOL 550-P™, a low weight average molecular weight polypropylene available from Sanyo Kasei K.K.; OMNOVA D1509®, available from IGI Chemicals as a wax dispersion and similar materials. Examples of functionalized waxes that can be selected for the disclosed toners include amines, and amides of, for example, AQUA SUPERSLIP 6550™, SUPERSLIP 6530™ available from Micro Powder Inc.; fluorinated waxes, for example, POLYFLUO 190™, POLYFLUO 200™, POLYFLUO 523XF™, AQUA POLYFLUO 411™, AQUA POLYSILK 19™, POLYSILK 14™ available from Micro Powder Inc.; mixed fluorinated, amide waxes, for example, MICROSPERSION 19™ also available from Micro Powder Inc.; imides, esters, quaternary amines, carboxylic acids or acrylic polymer emulsion of, for example, JONCRYL 74™, 89™, 130™, 537™, and 538™, all available from SC Johnson Wax; chlorinated polypropylenes and polyethylenes available from Allied Chemical, Petrolite Corporation, and from SC Johnson Wax. A number of these disclosed waxes can optionally be fractionated or distilled to provide specific cuts or portions that meet viscosity and/or temperature criteria wherein the viscosity is, for example, about 10,000 cps, and the temperature is about 100° C. In embodiments, the wax is selected from the group consisting of polyethylene, polypropylene, and mixtures thereof. In embodiments, the wax has a melting range of from about 70 to about 120° C., or from about 80 to about 100° C., or from about 85 to about 95° C.

In embodiments, the wax is in the form of a dispersion comprising, for example, a wax having a particle diameter of from about 100 nanometers to about 500 nanometers, or from about 100 nanometers to about 300 nanometers, water, and an anionic surfactant or a polymeric stabilizer, and optionally a nonionic surfactant. In embodiments, the wax comprises polyethylene wax particles, such as POLYWAX® 655, or POLYWAX® 725, POLYWAX® 850, POLYWAX® 500 (the POLYWAX® waxes being commercially available from Baker Petrolite) and, for example, fractionated/distilled waxes, which are distilled parts of commercial POLYWAX® 655 designated as X1214, X1240, X1242, X1244, and the like, but are not limited to POLYWAX® 655 cuts. Waxes providing a specific cut that meet the viscosity/temperature criteria, wherein the upper limit of viscosity is about 10,000 cps and the temperature upper limit is about 100° C., can be used. These waxes can have a particle diameter in the range of from about 100 to about 500 nanometers, although not limited to these diameters or sizes. Other wax examples include FT-100 waxes available from Shell (SMDA), and FNP0092 available from Nippon Seiro.

The surfactant used to disperse the wax can be an anionic surfactant, such as, for example, NEOGEN RK® commercially available from Daiichi Kogyo Seiyaku or TAYCAPOWER® BN2060 commercially available from Tayca Corporation, or DOWFAX® available from DuPont.

In embodiments, wax can be present in the toner in any suitable or desired amount. In the present embodiments, the wax may be present in the toner in a lower amount than previously required, such as from 2 to about 15, or from about 2 to about 13, or from about 4 to about 10, or from about 4 to about 6 percent by weight based on the total weight of the toner solids. In a specific embodiment, the wax is present in the toner in an amount of from about 4 to about 6 percent by weight, based on the total weight of toner solids. The toner wax amount can in embodiments be, for example, from about 0.1 to about 20 weight percent or percent by weight, from about 0.5 to about 15 weight percent, from about 1 to about 12 weight percent, from about 1 to about 10 weight percent, from about 2 to about 8 weight percent, from about 4 to about 9 weight percent, from about 1 to about 5 weight percent, from about 1 to about 4 weight percent, or from about 1 to about 3 weight percent based on the toner solids. The costs of the resulting toner can be decreased by adding a reduced amount of wax to the toner, to the toner surface, or both the toner and the toner surface, such as from about 4.5 weight percent to about 9 weight percent based on the solids. In embodiments, the wax is present in an amount of from about 2 to about 13 percent by weight, based on the total weight of the toner. In a specific embodiment, the wax is present in an amount of from about 4 to about 5 weight percent based on the total weight of the toner.

Colorant.

If a colorant is desired, any suitable or desired colorant can be selected for embodiments herein. The inclusion of a colorant is optional.

Examples of toner colorants include pigments, dyes, mixtures of pigments and dyes, mixtures of pigments, mixtures of dyes, and the like. In embodiments, the colorant comprises carbon black, magnetite, black, cyan, magenta, yellow, red, green, blue, brown, and mixtures thereof.

The toner colorant can be selected, for example, from cyan, magenta, yellow, or black pigment dispersions of each color in an anionic surfactant, or optionally in a non-ionic surfactant to provide, for example, pigment particles having a volume average particle diameter of, for example, from about 50 nanometers to about 300 nanometers, or from about 125 nanometers to about 200 nanometers. The surfactant used to disperse each colorant can be any number of known components such as, for example, an anionic surfactant like NEOGEN RK™. Known Ultimizer equipment can be used to provide the colorant dispersions, although media mills or other known processes can be utilized to generate the wax dispersions.

Toner colorant amounts vary, and can be, for example, from about 1 to about 50, from about 2 to about 40, from about 2 to about 30, from 1 to about 25, from 1 to about 18, from 1 to about 12, from 1 to about 6 weight percent, and from about 3 to about 10 percent by weight of total solids. When magnetite pigments are selected for the toner, the amounts thereof can be up to about 80 weight percent of solids like from about 40 to about 80 weight percent, or from about 50 to about 75 weight percent based on the total solids.

Specific toner colorants that may be selected include PALIOGEN VIOLET 5100™ and 5890™ (BASF), NORMANDY MAGENTA RD-2400™ (Paul Ulrich), PERMANENT VIOLET VT2645™ (Paul Ulrich), HELIOGEN GREEN L8730™ (BASF), ARGYLE GREEN XP-111-S™ (Paul Ulrich), BRILLIANT GREEN TONER GR 0991™ (Paul Ulrich), LITHOL SCARLET D3700™ (BASF), TOLUIDINE RED™ (Aldrich), Scarlet for THERMOPLAST NSD RED™ (Aldrich), LITHOL RUBINE TONER™ (Paul Ulrich), LITHOL SCARLET 4440™, NBD 3700™ (BASF), BON RED C™ (Dominion Color), ROYAL BRILLIANT RED RD-8192™ (Paul Ulrich), ORACET PINK RF™ (Ciba Geigy), PALIOGEN RED 3340™ and 3871K™ (BASF), LITHOL FAST SCARLET L4300™ (BASF), HELIOGEN BLUE D6840™, D7080™, K7090™, K6910™ and L7020™ (BASF), SUDAN BLUE OS™ (BASF), NEOPEN BLUE FF4012™ (BASF), PV FAST BLUE B2G01™ (American Hoechst), IRGALITE BLUE BCA™ (Ciba Geigy), PALIOGEN BLUE 6470™ (BASF), SUDAN II™, III™ and IV™ (Matheson, Coleman, Bell), SUDAN ORANGE™ (Aldrich), SUDAN ORANGE 220™ (BASF), PALIOGEN ORANGE 3040™ (BASF), ORTHO ORANGE OR 2673™ (Paul Ulrich), PALIOGEN YELLOW 152™ and 1560™ (BASF), LITHOL FAST YELLOW 0991K™ (BASF), PALIOTOL YELLOW 1840™ (BASF), NOVAPERM YELLOW FGL™ (Hoechst), PERMANERIT YELLOW YE 0305™ (Paul Ulrich), LUMOGEN YELLOW D0790™ (BASF), SUCOGELB 1250™ (BASF), SUCO-YELLOW D1355™ (BASF), SUCO FAST YELLOW D1165™, D1355™ and D1351™ (BASF), HOSTAPERM PINK E™ (Hoechst), FANAL PINK D4830™ (BASF), CINQUASIA MAGENTA™ (DuPont), PALIOGEN BLACK L9984™ (BASF), PIGMENT BLACK K801™ (BASF), and carbon blacks such as REGAL® 330 (Cabot), CARBON BLACK 5250™ and 5750™ (Columbian Chemicals), mixtures thereof, and the like.

Colorant examples include pigments present in water based dispersions, such as those commercially available from Sun Chemical, such as for example, SUNSPERSE BHD 6011™ (Blue 15 Type), SUNSPERSE BHD 9312™ (Pigment Blue 15), SUNSPERSE BHD 6000™ (Pigment Blue 15:3 74160), SUNSPERSE GHD 9600™ and GHD 6004™ (Pigment Green 7 74260), SUNSPERSE QHD 6040™ (Pigment Red 122), SUNSPERSE RHD 9668™ (Pigment Red 185), SUNSPERSE RHD 9365™ and 9504™ (Pigment Red 57), SUNSPERSE YHD 6005™ (Pigment Yellow 83), FLEXIVERSE YFD 4249™ (Pigment Yellow 17), SUNSPERSE YHD 6020™ and 6045™ (Pigment Yellow 74), SUNSPERSE YHD 600™ and 9604™ (Pigment Yellow 14), FLEXIVERSE LFD 4343™ and LFD 9736™ (Pigment Black 7), mixtures thereof, and the like. Water-based colorant dispersions that may be selected for the toner compositions disclosed herein include those commercially available from Clariant of, for example, HOSTAFINE Yellow GR™, HOSTAFINE Black T™ and Black TS™, HOSTAFINE Blue B2G™, HOSTAFINE Rubine F6B™ and magenta dry pigment, such as Toner Magenta 6BVP2213 and Toner Magenta EO2, which pigments can also be dispersed in a mixture of water and surfactants.

Examples of toner pigments selected and available in the wet cake or concentrated form containing water can be easily dispersed in water utilizing a homogenizer, or simply by stirring, ball milling, attrition, or media milling. In other instances, pigments are available only in a dry form, whereby a dispersion in water is effected by microfluidizing using, for example, a M-110 microfluidizer or an Ultimizer, and passing the pigment dispersion from about 1 to about 10 times through the microfluidizer chamber, or by sonication, such as using a Branson 700 sonicator, or a homogenizer, ball milling, attrition, or media milling with the optional addition of dispersing agents such as the aforementioned ionic or nonionic surfactants.

Further, specific colorant examples are magnetites, such as Mobay magnetites MO8029™, MO8960™; Columbian magnetites, MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™ or TMB-104™; and the like, or mixtures thereof.

Specific additional examples of pigments present in the toner in an amount of from 1 to about 40, from 1 to about 20, or from about 3 to about 10 weight percent of total solids include phthalocyanine HELIOGEN BLUE L6900™, D6840™, D7080™, D7020™, PYLAM OIL BLUE™, PYLAM OIL YELLOW™, PIGMENT BLUE 1™ available from Paul Ulrich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK™ and cyan components, may also be selected as pigments. The pigment dispersion comprises pigment particles dispersed in an aqueous medium with an anionic dispersant/surfactant or a nonionic dispersant/surfactant, and wherein the dispersant/surfactant amount is in the range of from about 0.5 to about 10 percent by weight or from about 1 to about 7 percent by weight.

Toner.

The toner compositions illustrated herein can be prepared by emulsion aggregation/coalescence methods as described in a number of patents inclusive, for example, of U.S. Pat. Nos. 5,593,807; 5,290,654; 5,308,734; 5,370,963; 6,120,967; 7,029,817; 7,736,832, and 8,466,254, the disclosures of each of these patents being totally incorporated herein by reference.

In embodiments, toner compositions may be prepared by any of the known emulsion-aggregation processes, such as a process that includes aggregating a mixture of an optional colorant, an optional wax and optional toner additives, with an emulsion comprising a single amorphous polyester resin and a crystalline polyester resin, aggregating, and then coalescing the aggregated mixture. The aforementioned resin mixture emulsion may be prepared by the known phase inversion process, such as by dissolving the amorphous polyester resin, and the crystalline polyester resin in a suitable solvent, followed by the addition of water like deionized water containing a stabilizer, and optionally a surfactant.

Examples of optional suitable stabilizers that are selected for the toner processes illustrated herein include aqueous ammonium hydroxide, water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. The stabilizer is typically present in amounts of, for example, from about 0.1 percent to about 5 percent, such as from about 0.5 percent to about 3 percent by weight, or weight percent of the colorant, wax and resin mixture. When salts are added as a stabilizer, it may be desirable in embodiments that incompatible metal salts are not present in the composition.

Suitable dissolving solvents utilized for the toner processes disclosed herein include alcohols, ketones, esters, ethers, chlorinated solvents, nitrogen containing solvents, and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. The resin mixture of the amorphous polyester and crystalline polyester can be dissolved in the solvent at elevated temperature of, for example, from about 40° C. to about 80° C., such as from about 50° C. to about 70° C. or from about 60° C. to about 65° C., with the desirable temperature in embodiments being lower than the glass transition temperature of the mixture of the wax and the amorphous polyester resin. In embodiments, the resin mixture is dissolved in the solvent at elevated temperature, but below the boiling point of the solvent, such as from about 2° C. to about 15° C. or from about 5° C. to about 10° C. below the boiling point of the solvent.

Optionally, an additional stabilizer, such as a surfactant, may be added to the disclosed aqueous emulsion medium to afford additional stabilization to the resin mixture. Suitable surfactants include anionic, cationic and nonionic surfactants. In embodiments, the use of anionic and nonionic surfactants can additionally help stabilize the aggregation process in the presence of the coagulant.

Anionic surfactant examples include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN® brand of anionic surfactants. An example of a suitable anionic surfactant is NEOGEN® R-K available from Daiichi Kogyo Seiyaku Co. Ltd. (Japan), TAYCAPOWER® BN2060 from Tayca Corporation (Japan), which consists primarily of branched sodium dodecyl benzene sulfonate, or Calfax® DB-45 (a branched C12 ballasted disulfonated diphenyloxide) from Pilot Chemical Company.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecyl benzyl triethyl ammonium chloride, MIRAPOL® and ALKAQUAT®, available from Alkaril Chemical Company, SANISOL® (benzalkonium chloride), available from Kao Chemicals, and the like. An example of a suitable cationic surfactant is SANISOL® B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc Inc. as IGEPAL® CA-210, IGEPAL® CA-520, IGEPAL® CA-720, IGEPAL® CO-890, IGEPAL® CG-720, IGEPAL® CO-290, ANTAROX® 890 and ANTAROX® 897. An example of a suitable nonionic surfactant is ANTAROX® 897 available from Rhone-Poulenc Inc., and which consists primarily of alkyl phenol ethoxylate.

Thus, there can be accomplished with the use of a homogenizer the blending and aggregation of the mixture of the crystalline polyester resin emulsion and the amorphous polyester resin in the presence of a colorant, and optionally a wax with an aggregating agent, such as aluminum sulfate, at a pH of, for example, from about 3 to about 5. The temperature of the resulting blend may be slowly raised to about 40° C. to about 65° C., or from about 35° C. to about 45° C., and held there for from about 3 hours to about 9 hours, such as about 6 hours, in order to provide, for example, from about 2 to about 15 microns or from about 3 microns to about 5 microns diameter aggregated particles, followed by the addition of the disclosed amorphous polyester emulsion, and optionally a wax emulsion to form a shell, and wherein the aggregated particle size increases to from about 4 microns to about 7 microns, followed by optionally adding more amorphous polyester emulsion for a second shell together with optionally a wax emulsion. The final aggregated particles mixture can then be neutralized with an aqueous sodium hydroxide solution or buffer solution to a pH of, for example, from about a pH of 8 to about a pH of about 9. The aggregated particles are then heated from about 50° C. to about 90° C., causing the particles to be coalesced into toner composites with particle sizes in average volume diameter of, for example, from about 1 to about 15 microns or from about 5 to about 7 microns, and with an excellent shape factor of, for example, of from about 105 to about 170, from about 110 to about 160, or from about 115 to about 130 as measured on the FPIA SYSMEX analyzer or by scanning electron microscopy (SEM) and image analysis (IA).

With further regard to the emulsion/aggregation/coalescence processes, following aggregation, the aggregates are coalesced as illustrated herein. Coalescence may be accomplished by heating the disclosed resulting aggregate mixture to a temperature that is about 5° C. to about 30° C. above the Tg of the amorphous resin. Generally, the aggregated mixture can be heated to a temperature of from about 50° C. to about 95° C. or from about 75° C. to about 90° C. In embodiments, during heating the aggregated mixture may also be stirred by an agitator having blades rotating at from about 200 to about 750 revolutions per minute to help with the coalescence of the particles, and where coalescence may be accomplished over a period of, for example, from about 3 to about 9 hours.

Optionally, during coalescence the particles may be controlled by adjusting the pH of the mixture obtained. Generally, to control the particle size, the pH of the mixture can be adjusted to from about 5 to about 8 using a base such as, for example, sodium hydroxide.

After coalescence, the mixture may be cooled to room temperature, about 25° C., and the toner particles generated may be washed with water and then dried. Drying may be accomplished by any suitable method including freeze drying, which is usually accomplished at temperatures of about −80° C. for a period of about 72 hours.

Subsequent to aggregation and coalescence, the toner particles in embodiments have a volume average particle diameter as illustrated herein, and of from about 1 to about 15 microns, from about 4 to about 15 microns, or from about 6 to about 11 microns, such as about 7 microns as determined by a Coulter Counter. The volume geometric size distribution (GSDv) of the toner particles may be in a range of from about 1.20 to about 1.35, and in embodiments less than about 1.25 as determined by a Coulter Counter.

Moreover, in embodiments of the present disclosure a pre-toner mixture can be prepared by combining a colorant, and optionally a wax and other toner components, stabilizer, surfactant, and both the disclosed crystalline polyester and the disclosed amorphous polyester into an emulsion, or a plurality of emulsions. In embodiments, the pH of the pre-toner mixture can be adjusted to from about 2.5 to about 4 by an acid such as, for example, acetic acid, nitric acid or the like. Additionally, in embodiments, the pre-toner mixture optionally may be homogenized. When the pre-toner mixture is homogenized, homogenization thereof may be accomplished by mixing at, for example, from about 600 to about 4,000 revolutions per minute with, for example, a TKA ULTRA TURRAX T50 probe homogenizer.

Following the preparation of the pre-toner mixture, an aggregate mixture is formed by adding an aggregating agent (coagulant) to the pre-toner mixture. The aggregating agent is generally comprised of an aqueous solution of a divalent cation or a multivalent cation containing material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature (Tg) of the amorphous polyester containing emulsion. In some embodiments, the aggregating agent may be added in an amount of from about 0.05 to about 3 parts per hundred (pph) and from about 1 to about 10 pph (parts per hundred) with respect to the weight of toner. The aggregating agent may be added to the pre-toner mixture over a period of from about 0 to about 60 minutes, and where aggregation may be accomplished with or without maintaining homogenization.

More specifically, in embodiments the toners of the present disclosure can be prepared by emulsion/aggregation/coalescence by (i) generating or providing a latex emulsion containing a mixture of an amorphous polyester resin, a crystalline polyester resin, water, and surfactants, and generating or providing a colorant dispersion containing colorant, water, and an ionic surfactant, or a nonionic surfactant; (ii) blending the latex emulsions with the colorant dispersion and optional additives, such as a wax; (iii) adding to the resulting blend a coagulant comprising a polymetal ion coagulant, a metal ion coagulant, a polymetal halide coagulant, a metal halide coagulant, or a mixture thereof; (iv) aggregating by heating the resulting mixture below or about equal to the glass transition temperature (Tg) of the amorphous polyester resin to form a core; (v) optionally adding a further latex comprised of the amorphous polyester resin emulsion and optionally a wax emulsion resulting in a shell; (vi) introducing a sodium hydroxide solution to increase the pH of the mixture to about 4, followed by the addition of a sequestering agent to partially remove coagulant metal from the aggregated toner in a controlled manner; (vii) heating the resulting mixture of (vi) about equal to or about above the Tg (glass transition temperature) of the amorphous resins mixture at a pH of from about 7 to about 9; (viii) maintaining the heating step until the fusion or coalescence of resins and colorant are initiated; (ix) changing the pH of the above (viii) mixture to arrive at a pH of from about 6 to about 7.5 thereby accelerating the fusion or the coalescence, and resulting in toner particles comprised of the amorphous polyester, the crystalline polyester, wax, and colorant; and (x) optionally, isolating the toner.

In the above disclosed specific toner emulsion/aggregation/coalescence processes, to assist in controlling the aggregation and coalescence of the particles, the aggregating agent can, if desired, be metered into the resin containing mixture selected over a period of time. For example, the aggregating agent can be metered into the resin containing mixture over a period of, in one embodiment, at least from about 5 minutes to about 240 minutes, from about 5 to about 200 minutes, from about 10 to about 100 minutes, from about 15 to about 50 minutes, or from about 5 to about 30 minutes. The addition of the aggregating agent or additive can also be performed while the mixture is maintained under stirred conditions of from about 50 rpm (revolutions per minute) to about 1,000 rpm, or from about 100 rpm to about 500 rpm, although the mixing speed can be outside of these ranges, and at a temperature that is below the glass transition temperature of the amorphous polyester resin of, for example, about 100° C., from about 10° C. to about 50° C., or from about 35° C. to about 45° C. although the temperature can be outside of these ranges.

The particles formed can be permitted to aggregate until a predetermined desired particle size is obtained, and where the particle size is monitored during the growth process until the desired or predetermined particle size is achieved. Composition samples can be removed during the growth process and analyzed, for example, with a Coulter Counter to determine and measure the average particle size. Aggregation can thus proceed by maintaining the elevated temperature, or by slowly raising the temperature to, for example, from about 35° C. to about 100° C. (although the temperature may be outside of this range), or from about 35° C. to about 45° C., and retaining the mixture resulting at this temperature for a time period of, for example, from about 0.5 hour to about 6 hours, and in embodiments of from about 1 hour to about 5 hours (although time periods outside of these ranges can be used) while maintaining stirring to provide the aggregated particles. Once the predetermined desired particle size is reached, the growth process is halted.

When the desired final size of the toner particles is achieved, the pH of the mixture can be adjusted with a base to a value, in one embodiment, of from about 6 to about 10, and in another embodiment of from about 6.2 to about 7, although a pH outside of these ranges can be used. The adjustment of the pH can be used to freeze, that is to stop toner particle growth. The base used to stop toner growth can include any suitable base, such as alkali metal hydroxides, including sodium hydroxide and potassium hydroxide, ammonium hydroxide, combinations thereof, and the like. In specific embodiments, ethylene diamine tetraacetic acid (EDTA) can be added to help adjust the pH to the desired values noted above. In specific embodiments, the base can be added in amounts of from about 2 to about 25 percent by weight of the mixture, and in more specific embodiments, from about 4 to about 10 percent by weight of the mixture, although amounts outside of these ranges can be used.

Following aggregation to the desired particle size, the particles can then be coalesced to the desired size and final shape, the coalescence being achieved by, for example, heating the resulting mixture to any desired or effective temperature of from about 55° C. to about 100° C., from about 75° C. to about 90° C., from about 65° C. to about 75° C., or about 75° C., although temperatures outside of these ranges can be used, which temperatures can be below the melting point of the crystalline resin to prevent or minimize plasticization. Higher or lower temperatures than those disclosed may be used for coalescence, it being noted that this temperature can be, for example, related to the toner components selected, such as the resins and resin mixtures, waxes, and colorants.

Coalescence can proceed and be performed over any desired or effective period of time, such as from about 0.1 hour to about 10 hours, from about 0.5 hour to about 8 hours, or about 4 hours, although periods of time outside of these ranges can be used.

After coalescence, the disclosed mixture can be cooled to room temperature, typically from about 20° C. to about 25° C. (although temperatures outside of this range can be used). The cooling can be rapid or slow, as desired. A suitable cooling method can include introducing cold water to a jacket around the reactor containing the individual toner components. After cooling, the toner particles can be optionally washed with water and then dried. Drying can be accomplished by any suitable method including, for example, freeze drying resulting in toner particles possessing a relatively narrow particle size distribution with a lower number ratio geometric standard deviation (GSDn) of from about 1.15 to about 1.40, from about 1.18 to about 1.25, from about 1.20 to about 1.35, or from 1.25 to about 1.35.

The toner particles prepared in accordance with the present disclosure can, in embodiments, have a volume average diameter as disclosed herein (also referred to as "volume average particle diameter" or "D50v"), and more specifically, the volume average diameter can be from about 1 to about 25, from about 1 to about 15, from about 1 to about 10, or from about 2 to about 5 microns. D50v, GSDv, and GSDn can be determined by using a measuring instrument, such as a Beckman Coulter Multisizer 3, operated in accordance with the manufacturer's instructions. Representative sampling can occur as follows. A small amount of the toner sample, about 1 gram, can be obtained and filtered through a 25 micrometer screen, then placed in isotonic solution to obtain a concentration of about 10 percent, with the sample then being subjected to a Beckman Coulter Multisizer 3.

Additionally, the toners disclosed herein can possess low melting properties, thus these toners may be a low melt or ultra-low melt toner. The disclosed low melt toners display a melting point of from about 80° C. to about 130° C., or from about 90° C. to about 120° C., while the disclosed ultra-low melt toners display a melting point of from about 50° C. to about 100° C., and from about 55° C. to about 90° C.

In embodiments, a toner process herein comprises mixing (a) a first amorphous polyester resin comprising a polyester derived from dodecenyl succinic acid, dodecenyl succinic anhydride, or a combination thereof; wherein the first amorphous polyester is generated by the catalytic polymerization of monomers of an organic diol, an organic diacid, and dodecenyl succinic acid, dodecenyl succinic anhydride, or a combination thereof; wherein the dodecenyl succinic acid, dodecenyl succinic anhydride, or combination thereof, is present in the first amorphous polyester in an amount of from about 5 to about 15 weight percent, based on the total weight of the first amorphous polyester; (b) a second amorphous polyester resin comprising a polyester derived from dodecenyl succinic acid, dodecenyl succinic anhydride, or a combination thereof, and a branching agent derived from a polyacid or polyol component; wherein the second amorphous polyester is generated by the catalytic polymerization of monomers of an organic diol, an organic diacid, dodecenyl succinic acid, dodecenyl succinic anhydride, or combination thereof, and the branching agent; wherein the dodecenyl succinic acid, dodecenyl succinic anhydride, or combination thereof is present in the second amorphous polyester in an amount of from about 5 to about 15 weight percent, based on the total weight of the second amorphous polyester; (c) a crystalline polyester resin; (d) a wax; and (e) an optional colorant; aggregating; and coalescing to form toner particles.

Toner Additives.

Any suitable surface additives may be selected for the disclosed toner compositions. Examples of additives are surface treated fumed silicas, such as for example TS-530® obtainable from Cabosil Corporation, with an 8 nanometer particle size and a surface treatment of hexamethyldisilazane; NAX50® silica, obtained from DeGussa/Nippon Aerosil Corporation, coated with HMDS; DTMS® silica, obtained from Cabot Corporation, comprised of a fumed silica silicon dioxide core L90 coated with DTMS; H2050EP®, obtained from Wacker Chemie, coated with an amino functionalized organopolysiloxane; metal oxides, such as TiO2, like for example MT-3103®, available from Tayca Corporation, with a 16 nanometer particle size and a surface treatment of decylsilane; SMT5103®, obtainable from Tayca Corporation, comprised of a crystalline titanium dioxide core MT500B coated with DTMS; P-25®, obtainable from Degussa Chemicals, with no surface treatment; alternate metal oxides, such as aluminum oxide, and as a lubricating agent, for example, stearates or long chain alcohols, such as UNILIN 700®, and the like. In general, silica is applied to the toner surface for toner flow, triboelectric enhancement, admix control, improved development and transfer stability, and higher toner blocking temperature. TiO2 is applied for improved relative humidity (RH) stability, tribo control, and improved development, and transfer stability.

The surface additives silicon oxides and titanium oxides, which should more specifically possess, for example, a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET surface area, are applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume average particle diameter of the toner as measured in the standard Coulter Counter method, and that the additive particles are distributed as primary particles on the toner surface in a hexagonal closed packed structure. Another metric relating to the amount and size of the additives is the sum of the "SAC.times.Size" (surface area coverage multiplied by the primary particle size of the additive in nanometers) for each of the silica and titania particles, or the like, for which all of the additives should, more specifically, have a total SAC.times.Size range of, for example, about 4,500 to about 7,200. The ratio of the silica to titania particles is generally from about 50 percent silica/50 percent titania to about 85 percent silica/15 percent titania (on a weight percentage basis).

Calcium stearate and zinc stearate can also be selected as toner additives primarily providing for toner lubricating properties, developer conductivity and triboelectric charge enhancement, higher toner charge and charge stability by increasing the number of contacts between the toner and carrier particles. Examples of the stearates are SYNPRO®, Calcium Stearate 392A and SYNPRO®, Calcium Stearate NF Vegetable or Zinc Stearate-L. In embodiments, the toners contain from, for example, about 0.1 to about 5 weight percent titania, about 0.1 to about 8 weight percent silica, and optionally from about 0.1 to about 4 weight percent calcium or zinc stearate.

Shell Formation.

An optional at least one shell of any suitable or desired composition, including any suitable or desired resin or combination of resins including those described herein can be selected. In embodiments, an optional at least one shell of an amorphous polyester resin and an optional wax resin can be applied to the aggregated toner particles obtained in the form of a core by any desired or effective method. For example, the shell resin can be in the form of an emulsion that includes the disclosed amorphous polyester or combination of amorphous polyesters, wax, and a surfactant. The formed aggregated particles can be combined with the shell resin emulsion so that the shell resin forms a shell over from 80 to 100 percent of the formed aggregates.

In embodiments, the toner comprises a core and a shell disposed thereover, wherein the core comprises the crystalline resin, amorphous resin, colorant and wax and wherein the shell comprises the amorphous resin. In embodiments, a toner herein comprises a core and a shell disposed thereover, wherein the core comprises the crystalline resin, the first and second amorphous polyester resin as described herein, colorant, and wax, and wherein the shell comprises at least one of the first amorphous polyester, the second amorphous polyester, or a combination of both the first amorphous polyester and the second amorphous polyester.

Developer Compositions.

Also encompassed by the present disclosure are developer compositions comprised of the toners illustrated herein and carrier particles. In embodiments, developer compositions comprise the disclosed toner particles mixed with carrier particles to form a two-component developer composition. In some embodiments, the toner concentration in the developer composition may range from about 1 weight percent to about 25 weight percent, such as from about 2 weight percent to about 15 weight percent, of the total weight of the developer composition.

Examples of carrier particles suitable for mixing with the disclosed toner compositions include those particles that are capable of triboelectrically obtaining a charge of opposite polarity to that of the toner particles, such as granular zircon, granular silicon, glass, steel, nickel, ferrites, iron ferrites, silicon dioxide, and the like. The selected carrier particles can be used with or without a coating, the coating generally being comprised of fluoropolymers, such as polyvinylidene fluoride resins; terpolymers of styrene; methyl methacrylate; silanes, such as triethoxy silane; tetrafluoroethylenes; other known coatings; and the like.

In applications in which the described toners are used with an image-developing device employing roll fusing, such as a xerographic imaging system, the carrier core may be at least partially coated with a polymethyl methacrylate (PMMA) polymer having a weight-average molecular weight of 300,000 to 350,000, for example, such as commercially available from Soken. PMMA is an electropositive polymer that will generally impart a negative charge on the toner by contact therewith. The coating has, in embodiments, a coating weight of from about 0.1 weight percent to about 5 weight percent, or from about 0.5 weight percent to about 2 weight percent of the carrier. PMMA may optionally be copolymerized with any desired comonomer such that the resulting copolymer retains a suitable particle size. Suitable co-monomers for the copolymerization can include monoalkyl or dialkyl amines, such as dimethylaminoethyl methacrylates, diethylaminoethyl methacrylates, diisopropylaminoethyl methacrylates, tert-butyl amino ethyl methacrylates, mixtures thereof, and the like. The carrier particles may be prepared by mixing the carrier core with from about 0.05 weight percent to about 10 weight percent of polymer, such as from about 0.05 weight percent to about 3 weight percent of polymer, based on the weight of the coated carrier particles, until the polymer coating adheres to the carrier core by mechanical impaction and/or electrostatic attraction. Various effective suitable means can be used to apply the polymer to the surface of the carrier core particles, for example, cascade-roll mixing, tumbling, milling, shaking, electrostatic powder-cloud spraying, fluidized bed, electrostatic disc processing, and with an electrostatic curtain. The mixture of carrier core particles and polymer is then heated to melt and fuse the polymer to the carrier core particles. The coated carrier particles are then cooled and classified to a desired particle size.

Carrier particles can be mixed with toner particles in any suitable combination, such as for example, from about 1 to about 5 parts by weight of carrier particles are mixed with from about 10 to about 300 parts by weight of the toner particles.

The toner compositions disclosed may also include known charge additives in effective amounts, such as from about 0.1 to about 10 weight percent, or from 1 to about 5 weight percent, such as alkyl pyridinium halides, bisulfates, other suitable known charge control additives, and the like. Surface additives that can be added to the toner compositions after washing or drying include, for example, those disclosed herein, like metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374, and 3,983,045, the disclosures of which are totally incorporated herein by reference. Examples of specific suitable additives include zinc stearate and AEROSIL R972®, available from Degussa, in amounts of from about 0.1 to about 2 percent, which can be added during the aggregation process or blended into the formed toner products.

Additionally, the present disclosure provides a method of developing a latent xerographic image comprising applying the toner composition described herein to a photoconductor, transferring the developed image to a suitable substrate like paper, and fusing the toner composition to the substrate by exposing the toner composition to heat and pressure.

Specific embodiments will now be described in detail. These examples are intended to be illustrative, and are not limited to the materials, conditions, or process parameters set forth therein. All parts are percentages by solid weight unless otherwise indicated, and the particle sizes were measured with a Multisizer 3® Coulter Counter available from Beckman Coulter. GSDv is calculated as the particle diameter at a cumulative 84% by volume divided by the particle diameter at a cumulative 50% by volume. GSDn is calculated as the particle diameter at a cumulative 50% by number divided by the particle diameter at a cumulative 16% by number.

For the Examples that follow, the cohesion can be measured at various temperatures (51° C., 52° C., 53° C., 54° C., 55° C.), followed by plotting the cohesion value versus temperature. The temperature, where the cohesion is intercepted at 20 percent cohesion, is considered the toner blocking temperature.

Cohesion refers to the percent of toner that does not flow through sieve(s) after the prepared toners were maintained in an oven at certain temperatures, such as 51° C. The temperature can then be increased from 51° C. to 52° C., 53° C., and the like, and the cohesion values can be measured at each of these temperatures. The cohesion value (at each temperature) can then be plotted versus temperature, and the temperature at which the cohesion value is about 20 percent was determined to be the blocking temperature.

More specifically, 20 grams of the prepared toners illustrated herein, from about 5 to about 8 microns in average volume diameter, were blended with about 2 to about 4 percent of surface additives, such as silica and/or titania, and sieve blended through a 106 micron screen. A 10 gram sample of each of the toners were placed into separate aluminum weighing pans, and the samples were conditioned in a bench top environmental chamber at various temperatures (51° C., 52° C., 53° C., 54° C., 55° C., 56° C., 57° C.), and 50 percent RH for 24 hours. After 24 hours, the toner samples were removed and cooled in air for 30 minutes prior to the measurements.

Each of the cooled toner samples were transferred from the weighing pan to a 1,000 micron sieve at the top of the sieve stack (top (A) 1,000 microns, bottom (B) 106 microns). The difference in weight was measured, which difference provides the toner weight (m) transferred to the sieve stack. The sieve stack containing the toner sample was loaded into the holder of a Hosokawa flow tester apparatus. The tester was operated for 90 seconds with a 1 millimeter amplitude vibration. Once the flow tester times out, the weight of toner remaining on each sieve was measured, and the percent heat cohesion was calculated using 100*(A+B)/m, where A is the mass of toner remaining on the 1,000 micron screen, B is the mass of toner remaining on the 106 micron screen, and m is the total mass of the toner placed on top of the set of stacked screens. The cohesion obtained at each temperature was then plotted against the temperature, and the point at which 20 percent cohesion was interpolated (or extrapolated) from the plot corresponded to the blocking temperature.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Example 1

A low molecular weight unbranched amorphous polyester comprised of 9.5% by weight of dodecenyl succinic acid was prepared as follows.

A 2 Liter Buchi reactor equipped with a mechanical stirrer, distillation apparatus and bottom drain valve, is charged with terephthalic (16.8 weight percent), dodecenyl succinic acid (9.5 weight percent) and propoxylated bisphenol A (71.8 weight percent), and butyl stannoic acid (2 grams) was heated to 225° C. over a 3 hour period under nitrogen, and maintained for an additional 5 hours. The reaction pressure was then reduced to 5 mm-Hg and maintained at 225° C. for an additional 5 hours, after which the reaction temperature was reduced to 190° C. at atmospheric pressure. To this was added fumaric acid (7.8 weight percent), hydroquinone (3 grams) and the temperature was increased to 200° C. and maintained for an additional 3 hours. The resulting polyester resin, was then discharged through the bottom drain valve into a metal pan, and allowed to cool to room temperature. The resulting thermal properties are listed in Table 1. An emulsion by Phase Inversion Emulsification was then prepared by standard procedure, to result in an aqueous dispersion of about 40% solids. See, for example, U.S. Patent Publication Number 20150168858, which is hereby incorporated by reference herein in its entirety, for a description of Phase Inversion Emulsification.

Examples 2-4

High molecular weight branched amorphous resin was prepared using the procedure and composition as Example I, except having adding thereto, the trimellitic acid (branching agent) in various amounts as listed in Table 1. Emulsions by Phase Inversion Emulsification were then prepared by the standard procedure, to result in an aqueous dispersion of about 40% solids.

Comparative Example 5

A branched amorphous polyester resin comprised of comprised of 21.5% by weight of dodecenyl succinic acid and 4.7% trimellitic acid was prepared as follows.

A 2 Liter Buchi reactor equipped with a mechanical stirrer, distillation apparatus and bottom drain valve, is charged with terephthalic (30 weight percent), dodecenyl succinic acid (21.5 weight percent) and propoxylated bisphenol A (27.8 weight percent), ethoxylated bisphenol A (6.9 weight percent), trimellitic acid (4.7 weight percent), and butyl stannoic acid (2 grams) was heated to 225° C. over a 3 hour period under nitrogen, and maintained for an additional 5 hours. The reaction pressure was then reduced to 5 mm-Hg and maintained at 225° C. for an additional 10 hours, after which the resin, was then discharged through the bottom drain valve into a metal pan, and allowed to cool to room temperature. The resulting thermal properties are listed in Table 1. An emulsion by Phase Inversion Emulsification was then prepared by the standard procedure, to result in an aqueous dispersion of about 40% solids.

TABLE 1

| Resin/ Example | Trimellitic Acid Weight % | AV | Tg (° C.) | Ts | Mn (PSE) | Mw (PSE) |
|---|---|---|---|---|---|---|
| Example 1 | 0 | 12.3 | 60.1 | 114.5 | 5,500 | 21,000 |
| Example 2 | 0.2 | 9.9 | 59.7 | 123 | 6,600 | 36,100 |
| Example 3 | 1 | 14.7 | 63.3 | 129 | 10,700 | 58,400 |
| Example 4 | 2.5 | 12.6 | 62.3 | 127.2 | 8,200 | 49,300 |
| Comparative Example 5 | 4.7 | 12 | 55 | 126 | 16,000 | 80,000 |

Example 6

Crystalline Polyester, poly(1,6-hexylene-1,12-dodecanoate), derived from 1,6-hexanediol and 1,12-dodecanedioic acid was prepared as follows.

A 2 Liter Buchi reactor equipped with a mechanical stirrer, distillation apparatus and bottom drain valve, is charged with 1,6-hexanediol (412 grams), 1,12-Dodecanedioic acid (800 grams) and Titanium (IV) Propoxide (1 gram). The mixture was heated to 225° C. under nitrogen over a 3 hour period and maintained for an additional 5 hours, after which the material was discharged into a metal pan and allowed to cool to room temperature. The crystalline resin, poly(1,6-hexylene-1,12-dodecanoate), displayed a melting point of 74° C., a recrystallization point of 58° C., an acid value of 11 mg of KOH/g, an number average molecular weight of 12,500 grams per mole and a weight average molecular weight of 23,400 grams per mole. An emulsion by Phase Inversion Emulsification was then prepared by prepared by the standard procedure, to result in an aqueous dispersion of about 40% solids.

Example 7

Toner with 4.5 Percent Wax. Into a 2 liter glass reactor equipped with an overhead mixer was added 128 grams of the amorphous polyester emulsion of Example 1, 122 grams of the branched amorphous polyester resin emulsion of Example 2, 30 grams of crystalline polyester emulsion of Example 6, 4.5 weight percent grams of polyethylene wax dispersion obtained from IGI, and 5.5 percent by weight Nipex® 35 carbon black pigment, 0.9 grams Dowfax® surfactant, and 390 grams deionized water were combined to form a slurry. The slurry was pH adjusted to 4.5 using 0.3M nitric acid. Then, 2.7 grams of aluminum sulphate mixed with 33 grams deionized water was added to the slurry under homogenization at 3,000 to 4,000 revolutions per minute (RPM). The reactor was set to 260 RPM and heated to 47° C. to aggregate the toner particles. When the particle sized reached 4.5 micrometers, a shell coating was adding consisting of 46 grams of the amorphous polyester of Example 1, and all pH was adjusted to 6 using 0.3M nitric acid. When the particle sized reached 4.8 to 5.0 micrometers, a second shell coating was added consisting of 46 grams of the amorphous polyester emulsion of Example 1, 43 grams of branched amorphous polyester emulsion of Example 5 and all pH was adjusted to 6 using 0.3M nitric acid. The reaction was further heated to 53° C. When the toner particle sized reached 5.6 to 6.5 micrometers, freezing was started by adjusting the pH of the slurry to 4.5 using a 4 percent NaOH solution. The reactor RPM was decreased to 240 followed by adding 5.77 grams of a chelating agent (VERSENE™ 100) and more NaOH solution until the pH reached 8.1. The reactor temperature was ramped to 85° C. The pH of the slurry was maintained at 8.1 or greater until the temperature reached 85° C. (coalescence temperature). Once at the coalescence temperature, the slurry pH was reduced to 7.3 using a pH 5.7 Buffer and coalesced for 80 minutes where the particle circularity was between 0.970 and 0.980 as measured by the Malvern® Sysmex® FPIA3000 Flow Particle Image Analysis (FPIA) instrument. The slurry was then quenched cooled in 360 grams of deionized ice. The final particle size was 5.77 micrometers, GSDv 1.22, and circularity of 0.971. The toner was then washed and freeze-dried.

Examples 8, 9, 10, and 11

Toners of Examples 8, 9, 10, and 11 were prepared as in Example 7 but having the resin composition as shown in Table 2 with varying ratios of un-branched and branched resin to optimize for blocking and fusing (gloss/latitude). The toners of Examples 8, 9, 10, and 11 contained 4.5 percent polyethylene, wax and 6.8 percent by weight of the crystalline resin of Example 6, and 5.5% by weight of Nipex® 35 carbon black pigment.

TABLE 2

| Example | Ratio Resin:Branched Resin | Branched Resin | Toner (Size, GSDv/GSDn/circularity) | Blocking (° C.) |
|---|---|---|---|---|
| 7 | 70:30 | Example 2 | 5.77 μm (1.22/1.22/0.971) | 53 |
| 8 | 100:0 | — | 5.77 μm (1.20/1.21/0.971) | 54 |
| 9 | 80:20 | Example 3 | 5.95 μm (1.23/1.24/0.973) | 53 |
| 10 | 80:20 | Example 4 | 5.71 μm (1.21/1.22/0.965) | 54 |
| 11 | 80:20 | Example 5 | 5.71 μm (1.17/1.19/0.970) | 50 |

The toners of Examples 7 to 10 containing the unbranched and branched resins derived from 9.5% by weight of dodecenyl succinic acid, displayed acceptable blocking of 53 to 54° C. The toner of Examples 11 containing the unbranched and branched resins derived from 21.5% by weight of dodecenyl succinic acid, displayed an unacceptable blocking of 50° C.

The fusing performance of the toners of Examples 7 to 11 were similar to benchmark Xerox® 800 toner.

TABLE 3

| | Gloss Temperature (° C.) | | | | Peak Gloss |
|---|---|---|---|---|---|
| Example | $T(G_{30})$ | $T(G_{40})$ | $T(G_{50})$ | $T(G_{60})$ | $G_{max}$ |
| Xerox ® 800 | 125 | 133 | 142 | 155 | 65.2 |
| Example 7 | 126 | 132 | 139 | 146 | 77.1 |
| Example 9 | 126 | 133 | 140 | 147 | 77.0 |

TABLE 4

| Example | COT (° C.) | Mottle (° C.) | HOT (° C.) 220 mm/s | Crease Temperature (° C.) $T(C_{80})$ | $T(C_{40})$ |
|---|---|---|---|---|---|
| Xerox ® 800 | 123 | 190 | 195 | 123 | 126 |
| Example 7 | 113 | 190 | 200 | 116 | 120 |
| Example 9 | 110 | 190 | 195 | 115 | 121 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner composition comprising:

(a) a first amorphous polyester resin comprising a polyester derived from dodecenyl succinic acid, dodecenyl succinic anhydride, or a combination thereof;

wherein the first amorphous polyester is generated by the catalytic polymerization of monomers of an organic diol, an organic diacid, and dodecenyl succinic acid, dodecenyl succinic anhydride, or a combination thereof;

wherein the dodecenyl succinic acid, dodecenyl succinic anhydride, or combination thereof, is present in the first amorphous polyester in an amount of from about 5 to about 15 weight percent, based on the total weight of the first amorphous polyester;

(b) a second amorphous polyester resin comprising a polyester derived from dodecenyl succinic acid, dodecenyl succinic anhydride, or a combination thereof, and a branching agent derived from a polyacid or polyol component;

wherein the second amorphous polyester is generated by the catalytic polymerization of monomers of an organic diol, an organic diacid, dodecenyl succinic acid, dodecenyl succinic anhydride, or combination thereof, and the branching agent;

wherein the dodecenyl succinic acid, dodecenyl succinic anhydride, or combination thereof is present in the second amorphous polyester in an amount of from about 5 to about 15 weight percent, based on the total weight of the second amorphous polyester;

(c) a crystalline polyester resin;

(d) a wax; and (e) optionally, a colorant.

2. The toner of claim 1, wherein the first amorphous polyester resin is a low molecular weight polyester having a molecular weight of from about 15,000 to about 25,000 grams per mole; and wherein the first amorphous polyester resin has a glass transition temperature of from about 55 to about 65° C.

3. The toner of claim 1, wherein the first amorphous polyester resin comprises dodecenyl succinic acid, dodecenyl succinic anhydride, or combination thereof, in an amount of from about 9 to about 13 weight percent, based on the total weight of the first amorphous polyester.

4. The toner of claim 1, wherein the first amorphous polyester resin is selected from the group consisting of fumaric acid, terephthalic acid, dodecenyl succinic acid, dodecenyl succinic anhydride, propoxylated bisphenol A and ethoxylated bisphenol A.

5. The toner of claim 1, wherein the second amorphous polyester resin is a high molecular weight polyester having a molecular weight of from about 50,000 to about 150,000 grams per mole; and wherein the second amorphous polyester resin has a glass transition temperature of from about 52 to about 62° C.

6. The toner of claim 1, wherein the second amorphous polyester resin comprises dodecenyl succinic acid, dodecenyl succinic anhydride, or combination thereof, in an amount of from about 9 to about 13 weight percent, based on the total weight of the second amorphous polyester.

7. The toner of claim 1, wherein the second amorphous polyester resin is generated with a branching agent selected from the group consisting of trimellitic acid, trimellitic anhydride, and glycerol.

8. The toner of claim 1, wherein the second amorphous polyester resin is selected from the group consisting of terephthalic acid, dodecenyl succinic acid, dodecenyl succinic anhydride, trimellitic acid, propoxylated bisphenol A and ethoxylated bisphenol A.

9. The toner of claim 1, wherein the crystalline polyester resin is selected from the group consisting of poly(1,2-propylene-diethylene-terephthalate), poly(ethylene-terephthalate), poly(propylene-terephthalate), poly(butylene-terephthalate), poly(pentylene-terephthalate), poly(hexylene-terephthalate), poly(heptylene-terephthalate), poly(octylene-terephthalate), poly(ethylene-sebacate) (10:2), poly(propylene-sebacate) (10:3), poly(butylene-sebacate) (10:4), poly(hexylene-sebacate) (10:6), poly(nonylene-sebacate) (10:9), poly(decylene-sebacate) (10:10), poly(dodecylene-sebacate) (10:12), poly(ethylene-adipate) (6:2), poly(propylene-adipate) (6:3), poly(butylene-adipate) (6:4), poly(pentylene-adipate) (6:4), poly(hexylene-adipate) (6:6), poly(heptylene-adipate) (6:7), poly(octylene-adipate) (6:8), poly(ethylene-glutarate) (5:2), poly(propylene-glutarate) (5:3), poly(butylene-glutarate) (5:4), poly(pentylene-glutarate) (5:5), poly(hexylene-glutarate) (5:6), poly(heptylene-glutarate) (5:7), poly(octylene-glutarate) 5:8), poly(ethylene-pimelate) (7:2), poly(propylene-pimelate) (7:3), poly(butylene-pimelate) (7:4), poly(pentylene-pimelate) (7:5), poly(hexylene-pimelate) (7:6), poly(heptylene-pimelate) (7:7), poly(1,2-propylene itaconate), poly(ethylene-succinate) (4:2), poly(propylene-succinate) (4:3), poly(butylene-succinate) (4:4), poly(pentylene-succinate) (4:5), poly(hexylene-succinate) (4:6), poly(octylene-succinate) (4:8), poly(ethylene-dodecanoate) (12:2), poly(propylene-dodecanoate) (12:3), poly(butylene-dodecanoate) (12:4), poly(pentylene-dodecanoate) (12:5), poly(hexylene-dodecanoate) (12:6), poly(nonylene-dodecanoate) (12:9), poly(decylene-dodecanoate) (12:10), poly(dodecylene-dodecanoate) (12:12), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and mixtures thereof.

10. The toner of claim 1, wherein the crystalline polyester has an oligomer unit with a carbon to oxygen ratio of from about 3 to about 7.

11. The toner of claim 1, wherein the crystalline polyester has an oligomer unit having from about 12 to about 28 carbon atoms.

12. The toner of claim 1, wherein the first amorphous polyester resin comprises dodecenyl succinic acid, dodecenyl succinic anhydride, or combination thereof, in an amount of from about 9 to about 13 weight percent, based on the total weight of the first amorphous polyester;

wherein the second amorphous polyester resin comprises dodecenyl succinic acid, dodecenyl succinic anhydride, or combination thereof, in an amount of from about 9 to about 13 weight percent, based on the total weight of the second amorphous polyester; and wherein the crystalline polyester has an oligomer unit with a carbon to oxygen ratio of from about 3 to about 7.

13. The toner of claim 1, wherein the wax is present in an amount of from about 2 to about 13 percent by weight, based on the total weight of the toner.

14. The toner of claim 1, wherein the wax is selected from the group consisting of polyethylene, polypropylene, and mixtures thereof.

15. The toner of claim 1, wherein the toner comprises a core and a shell disposed thereover;

wherein the core comprises the crystalline resin, the first and second amorphous polyester resin, the colorant, and the wax; and wherein the shell comprises at least one of the first amorphous polyester, the second amorphous polyester, or a combination of both the first amorphous polyester and the second amorphous polyester.

16. A process comprising:

mixing (a) a first amorphous polyester resin comprising a polyester derived from dodecenyl succinic acid, dodecenyl succinic anhydride, or a combination thereof; wherein the first amorphous polyester is generated by the catalytic polymerization of monomers of an organic diol, an organic diacid, and dodecenyl succinic acid, dodecenyl succinic anhydride, or a combination thereof; wherein the dodecenyl succinic acid, dodecenyl succinic anhydride, or combination thereof, is present in the first amorphous polyester in an amount of from about 5 to about 15 weight percent, based on the total weight of the first amorphous polyester;

(b) a second amorphous polyester resin comprising a polyester derived from dodecenyl succinic acid, dodecenyl succinic anhydride, or a combination thereof, and a branching agent derived from a polyacid or polyol component; wherein the second amorphous polyester is generated by the catalytic polymerization of monomers of an organic diol, an organic diacid, dodecenyl succinic acid, dodecenyl succinic anhydride, or combination thereof, and the branching agent; wherein the dodecenyl succinic acid, dodecenyl succinic anhydride, or combination thereof is present in the second amorphous polyester in an amount of from about 5 to about 15 weight percent, based on the total weight of the second amorphous polyester;

(c) a crystalline polyester resin;

(d) a wax; and (e) optionally, a colorant;

aggregating; and coalescing to form toner particles.

17. The process of claim 16, wherein the first amorphous polyester resin is a low molecular weight polyester having a molecular weight of from about 15,000 to about 25,000 grams per mole; and wherein the first amorphous polyester resin has a glass transition temperature of from about 55 to about 65° C.

18. The process of claim 16, wherein the second amorphous polyester resin is a high molecular weight polyester having a molecular weight of from about 50,000 to about 150,000 grams per mole; and wherein the second amorphous polyester resin has a glass transition temperature of from about 55 to about 62° C.

19. The process of claim 16, wherein the crystalline polyester resin is selected from the group consisting of poly(1,2-propylene-diethylene-terephthalate), poly(ethylene-terephthalate), poly(propylene-terephthalate), poly(butylene-terephthalate), poly(pentylene-terephthalate), poly(hexylene-terephthalate), poly(heptylene-terephthalate), poly(octylene-terephthalate), poly(ethylene-sebacate) (10:2), poly(propylene-sebacate) (10:3), poly(butylene-sebacate) (10:4), poly(hexylene-sebacate) (10:6), poly(nonylene-sebacate) (10:9), poly(decylene-sebacate) (10:10), poly(dodecylene-sebacate) (10:12), poly(ethylene-adipate) (6:2), poly(propylene-adipate) (6:3), poly(butylene-adipate) (6:4), poly(pentylene-adipate) (6:4), poly(hexylene-adipate) (6:6), poly(heptylene-adipate) (6:7), poly(octylene-adipate) (6:8), poly(ethylene-glutarate) (5:2), poly(propylene-glutarate) (5:3), poly(butylene-glutarate) (5:4), poly(pentylene-glutarate) (5:5), poly(hexylene-glutarate) (5:6), poly(heptylene-glutarate) (5:7), poly(octylene-glutarate) 5:8), poly(ethylene-pimelate) (7:2), poly(propylene-pimelate) (7:3), poly(butylene-pimelate) (7:4), poly(pentylene-pimelate) (7:5), poly(hexylene-pimelate) (7:6), poly(heptylene-pimelate) (7:7), poly(1,2-propylene itaconate), poly(ethylene-succinate) (4:2), poly(propylene-succinate) (4:3), poly(butylene-succinate) (4:4), poly(pentylene-succinate) (4:5), poly(hexylene-succinate) (4:6), poly(octylene-succinate) (4:8), poly(ethylene-dodecanoate) (12:2), poly(propylene-dodecanoate) (12:3), poly(butylene-dodecanoate) (12:4), poly(pentylene-dodecanoate) (12:5), poly(hexylene-dodecanoate) (12:6), poly(nonylene-dodecanoate) (12:9), poly(decylene-dodecanoate) (12:10), poly(dodecylene-dodecanoate) (12:12), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and mixtures thereof.

20. The process of claim 16, wherein the crystalline polyester has an oligomer unit with a carbon to oxygen ratio of from about 3 to about 7.

* * * * *